United States Patent [19]

Angerer

[11] 4,367,839

[45] Jan. 11, 1983

[54] METHOD AND APPARATUS FOR THE PRODUCTION OF METAL STRIPS OF INDEFINITE LENGTH FROM ROLLED-STRIP SECTIONS

[76] Inventor: Klaus Angerer, Weiherstrasse 7, 8551 Röttenbach, Fed. Rep. of Germany

[21] Appl. No.: 181,157

[22] Filed: Aug. 22, 1980

[30] Foreign Application Priority Data

Aug. 23, 1979 [DE] Fed. Rep. of Germany ..... 2934115

[51] Int. Cl.[3] ..... B23K 28/02; B21C 49/00; B21B 41/00

[52] U.S. Cl. ..... 228/155; 242/80; 228/5.7; 228/47

[58] Field of Search ..... 228/5.7, 155, 158, 176, 228/243, 47; 242/78.1, 78.2, 80

[56] References Cited

U.S. PATENT DOCUMENTS 2,195,008 3/1940 Lessmann ..... 242/78.1

OTHER PUBLICATIONS

Article by H. Pötschke titled "Wirtschaftliches Rohrfertigen mit modernen Groszspeichern" published in Bander Bleche Rohre, 1978, vol. 8, pp. 327 and 328.

*Primary Examiner*—Kenneth J. Ramsey
*Attorney, Agent, or Firm*—Karl F. Ross

[57] ABSTRACT

Metal strips of indefinite length are made from a plurality of limited-length rolled-strip sections by temporarily clamping adjoining ends of a pair of such strip sections between semi-cylindrical halves of a reel and welding them together while the reel is rotated to wind the two strip sections into a double-layer coil thereon. A trailing end of the second strip section of this pair is then similarly joined to a leading end of a third strip section in another such reel, upstream of the former; as the two reels are rotated in opposite directions, the first strip section is fed forward from the unwinding double-layer coil of the downstream reel while the second strip section is fed back to be wound jointly with the third strip section into another double-layer coil on the upstream reel. In an analogous manner, further strip sections can be joined to the preceding ones with the aid of one additional reel whereupon the first reel becomes available for positioning upstream of the last one to continue the process.

7 Claims, 4 Drawing Figures

METHOD AND APPARATUS FOR THE PRODUCTION OF METAL STRIPS OF INDEFINITE LENGTH FROM ROLLED-STRIP SECTIONS

FIELD OF THE INVENTION

My present invention relates to a method and an apparatus for the production of metal strips of indefinite length from rolled-strip sections of limited length in which the trailing end of a preceding strip section is welded to the leading end of a succeeding strip section while the moving strip material is temporarily wound upon a reel for interim storage and is thereupon unwound therefrom for continuous further processing or treatment.

BACKGROUND OF THE INVENTION

In the German periodical "Bänder, Bleche, Rohre", 1978, vol. 8, pp. 327 and 328, there has been described a continuous-production process in the manufacture of pipes, welded along longitudinal seams, whereby metal strips of indefinite length are made from limited-length rolled-strip sections by welding the trailing end of one strip section to the leading end of a succeeding strip section. Lest the performing of the welding operations between adjoining ends of consecutive strip sections interrupt the continuous further processing of the strip material, there is integrated into the tube-making plant a strip store in which the moving strip material is temporarily accumulated in the form of a coil, with a significant number of turns, from which it can subsequently be withdrawn for further treatment.

This known system for the manufacture of elongate metal strips has the disadvantage of requiring considerable equipment since, in addition to the strip store designed as a so-called "supercoiler" with an outer diameter of more than 14 meters, there is also needed in each instance an inlet and an outlet twist track of relatively great length for the strip material, each requiring a plant area of corresponding length for its accommodation.

OBJECT OF THE INVENTION

It is the object of my present invention to reduce the equipment required for the manufacture of metal strips of indefinite length from limited-length rolled-strip sections in order to enable the continuous further processing or treatment of the strip material with a considerably lower investment of space and equipment.

SUMMARY OF THE INVENTION

A process according to my invention comprises the steps of welding a trailing end of a first strip section to a confronting leading end of a second strip section, clamping the welded ends of these strip sections between halves of a first reel which is then unidirectionally rotated to wind these two strip sections into a first double-layer coil thereon, welding a trailing end of the second strip section to a leading end of a third strip section, clamping the welded ends of the latter two strip sections between halves of a second reel disposed upstream of the first reel, unidirectionally rotating the second reel while simultaneously rotating the first reel in a direction opposite its previous sense of rotation for unwinding the first and second strip sections therefrom whereby the first strip section is fed forward and the second strip section is fed back for joint winding with the third strip section into a second double-layer coil on the second reel, welding a trailing end of the third strip section to a leading end of a fourth strip section, unclamping the welded ends of the first and second strip sections from the first reel, and rotating the second reel in a direction opposite its previous sense of rotation for unwinding the second and third strip sections therefrom.

In an analogous manner, I may continue that process by clamping the welded ends of the third and fourth strip sections between halves of a third reel, disposed upstream of the second reel, and unidirectionally rotating that third reel concurrently with the reverse rotation of the second reel for jointly winding the third and fourth strip sections into a third double-layer coil on the third reel preparatorily to the welding of a trailing end of the fourth strip section to a leading end of a fifth strip section. The first reel, from which the strip sections previously clamped thereby have been released, is now available for positioning upstream of the third reel to clamp the welded ends of the fourth and fifth strip sections which can thus be wound into a further double-layer coil on that first reel concurrently with an unwinding of the third and fourth strip sections from the third reel.

An apparatus according to my invention, designed to carry out the process just described, thus comprises the aforementioned reels each provided with clamping means for gripping confronting ends of a pair of adjoining strip sections. These reels, advantageously, are each provided with welding means for permanently joining the clamped strip ends together; the welding may take place during the winding and unwinding operations, i.e. while the reels are sequentially rotated in opposite directions and in pairs by associated drive means for the temporary buildup of the various double-layer coils thereon.

BRIEF DESCRIPTION OF THE DRAWING

The above and other features of my invention will now be described in detail with reference to the accompanying drawing in which.

SPECIFIC DESCRIPTION

Figure 1:
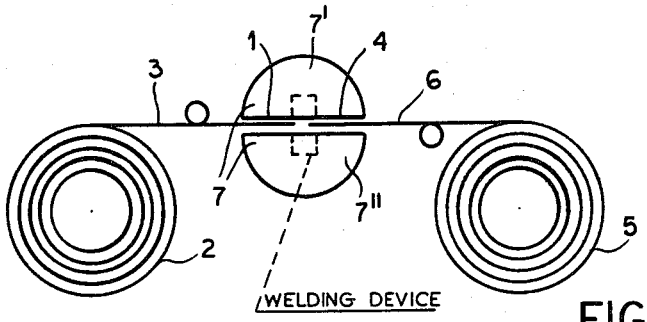
FIG. 1 is a somewhat diagrammatic view of a first reel engaging confronting ends of two strip sections.

The means for driving the several reels have been symbolized in the drawing by arrows showing the direction of rotation.

FIG. 1 shows how the trailing end 1 of a first rolled-strip section 3 of limited length, wound into a coil 2, is juxtaposed in a split reel 7 with the leading end 4 of another such rolled-strip section 6, also wound into a coil 5, in order to be firmly united therein by end-to-end welding into a longer metal strip.

Figure 2:
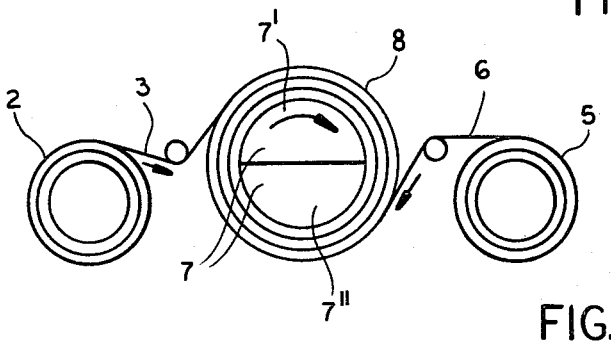
FIG. 2 shows the reel of FIG. 1 in the process of building up a double-layer coil thereon.

From FIG. 2 it is apparent that the two strip sections 3 and 6, unwound from coils 2 and 5, are jointly and codirectionally wound upon the clockwise-rotating reel 7, starting from their interconnected ends 1 and 4 which are gripped or clamped between halves 7′, 7″ of the reel to form a double-layer coil 8 temporarily stored thereon.

The interconnection of the ends 1 and 4 of the two strip sections 3 and 6 can take place, as soon as they are clamped in reel 7, by means of a welding device integrated into same so that sufficient time is available during the winding operation for the satisfactory completion of the welding seam.

The two semicylindrical halves 7′, 7″ of reel 7 can be separated for the insertion of strip ends 1 and 4 and can be moved toward each other for gripping and welding same as is apparent from FIG. 2.

Figure 3:
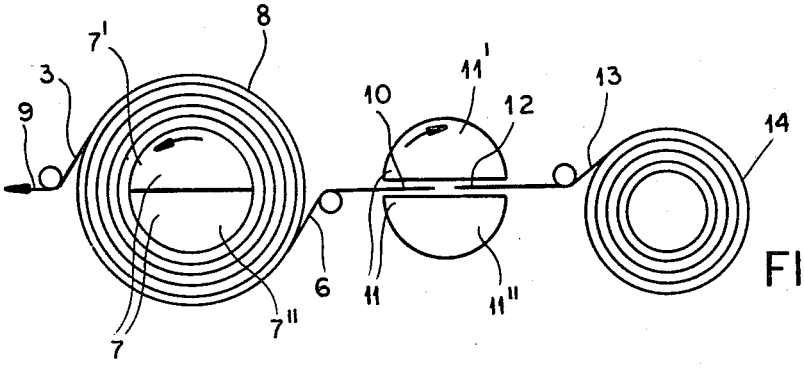
FIG. 3 shows a second reel disposed upstream of the loaded first reel, engaging confronting ends of one of the previous strip sections and of a third strip section.

As soon as the two strip sections 3 and 6 have been fully combined into the double-layer coil 8, the leading end 9 of strip section 3, as indicated in FIG. 3, can be passed to a plant for further processing while the trailing end 10 of strip section 6 is inserted between two halves 11′ and 11″ of another reel 11 upstream of reel 7.

The leading end 12 of a further limited-length strip section 13 can then be introduced from the opposite side between the two halves 11′ and 11″ of reel 11 and clamped thereby for welding to end 10. The strip section 13 may be unwound from a coil 14.

If, now, the reel 7 carrying the double-layer coil 8 is rotated counterclockwise, strip section 3 passes into the plant for further processing. Simultaneously, reel 11 is rotated counterclockwise so that strip section 6 is wound thereon together with the succeeding strip section 13 into a double-layer coil 15 shown in FIG. 4.

Figure 4:
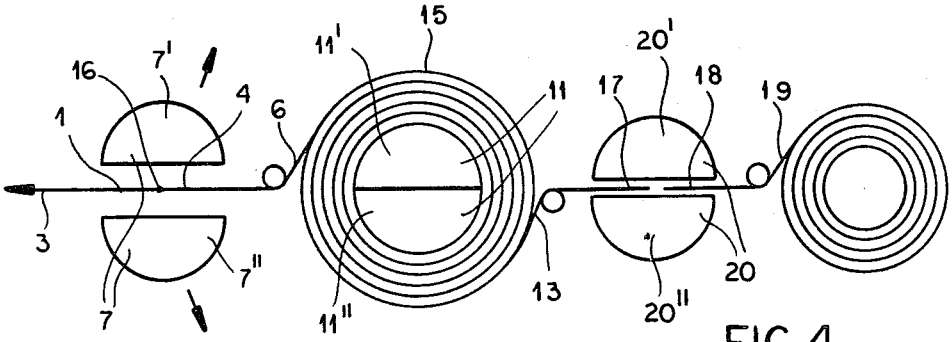
FIG. 4 shows the reels of FIG. 3 supplemented by a third reel, upstream of the loaded second reel, engaging confronting ends of the third and of a fourth strip section.

After the double-layer coil 8 has been fully unwound from reel 7, its two halves 7′ and 7″ are separated as also appears from FIG. 4. Since the trailing end 1 of strip section 3 is firmly connected by the welding seam 16 with the leading end 4 of strip section 6, the latter is withdrawn from the coil 15 of reel 11 immediately behind strip section 3. Simultaneously, however, there is unwound from coil 15 the third strip section 13 whose trailing end 17 is clamped together with the leading end 18 of a fourth rolled-strip section 19 between the two halves 20′ and 20″ of a further reel 20. Reel 20 is then driven clockwise whereby the interconnected strip sections 13 and 19 are wound thereon as a double-layer coil even as strip section 6 passes to the plant for further processing.

Reel 7, relieved of coil 8 and opened, is swung out while reel 11 with coil 15 moves into the previous position of reel 7 and reel 20 occupies the previous position of reel 11.

Reel 7 is thus free to be brought into the previous position of reel 20 where it will receive, in a double-layer coil, the strip section 19 together with a nonillustrated fifth strip section while strip section 13 welded to strip section 6 passes to the plant for further processing.

I claim:

1. A method of producing a metal strip of indefinite length from a plurality of limited-length rolled-strip sections joined to one another end-to-end, comprising the steps of:

(a) welding a trailing end of a first strip section to a confronting leading end of a second strip section;

(b) clamping the welded ends of said first and second strip sections between halves of a first reel;

(c) unidirectionally rotating said first reel to wind said first and second strip sections into a first double-layer coil thereon;

(d) welding a trailing end of said strip section to a leading end of a third strip section;

(e) clamping the welded ends of said second and third strip sections between halves of a second reel disposed upstream of said first reel;

(f) unidirectionally rotating said second reel while simultaneously rotating said first reel in a direction opposite that of step (c) for unwinding said first and second strip sections therefrom, said first strip section being fed forward while said second strip section is fed back for joint winding with said third strip section into a second double-layer coil on said second reel;

(g) welding a trailing end of said third strip section to a leading end of a fourth strip section;

(h) unclamping the welded ends of said first and second strip sections from said first reel; and (i) rotating said second reel in a direction opposite that of step (f) for unwinding said second and third strip sections therefrom.

2. A method as defined in claim 1, comprising the further steps of:

(j) clamping the welded ends of said third and fourth strip sections between halves of a third reel disposed upstream of said second reel;

(k) unidirectionally rotating said third reel, concurrently with the rotation of said second reel in step (i), for winding said fourth strip section jointly with said strip section, fed back from said second reel, into a third double-layer coil on said third reel preparatorily to a welding of a trailing end of said fourth strip section to a leading end of a fifth strip section.

3. A method as defined in claim 2 wherein said first reel, after unclamping in step (h), is positioned upstream of said third reel for clamping the welded ends of said fourth and fifth strip sections and winding same into a further double-layer coil concurrently with an unwinding of said third and fourth strip sections from said third reel.

4. A method as defined in claim 1, 2 or 3 wherein the welding of adjoining ends of successive strip sections takes place in the reel in which said adjoining ends are clamped.

5. An apparatus for producing metal strips of indefinite length from a plurality of limited-length rolled-strip sections joined to one another end-to-end, comprising:

a first, a second and a third reversibly rotatable reel each provided with clamping means for gripping confronting ends of a pair of adjoining strip sections;

welding means in each of said reels for permanently joining said confronting ends together; and drive means for sequentially rotating said reels in opposite directions and in pairs for jointly winding a first and a second strip section with welded ends into a first double-layer coil on said first reel, unwinding the first and second strip sections from said first strip section welded thereto into a second double-layer coil on said second reel, and unwinding the second and third strip sections from said second reel after releasing the first and second strip sections from said first reel while jointly winding the third strip section and a fourth strip section welded thereto into a third double-layer coil on said third reel.

6. An apparatus as defined in claim 5 wherein each of said reels has separable semicylindrical halves provided with said clamp means.

7. An apparatus as defined in claim 5 or 6 wherein said first reel is displaceable from a position downstream of said second reel to a position upstream of said third reel.

* * * * *